US010433644B2

(12) United States Patent
Kamiya et al.

(10) Patent No.: US 10,433,644 B2
(45) Date of Patent: Oct. 8, 2019

(54) TILTABLE STOOL AND TILTABLE LOUNGE CHAIR

(71) Applicants: QUALI CO., LTD., Anjo-shi, Aichi (JP); CHAIR MEISTER CO., LTD., Gimpo, Gyeonggi (KR)

(72) Inventors: Nariaki Kamiya, Anjo (JP); Toshiharu Okazaki, Anjo (JP); Mitsuru Haseda, Anjo (JP)

(73) Assignees: QUALI CO., LTD., Anjo-shi (JP); CHAIR MEISTER CO., LTD., Gyeonggi (KR)

( * ) Notice: Subject to any disclaimer, the term of this patent is extended or adjusted under 35 U.S.C. 154(b) by 0 days.

(21) Appl. No.: 16/225,442

(22) Filed: Dec. 19, 2018

(65) Prior Publication Data

US 2019/0116979 A1 Apr. 25, 2019

Related U.S. Application Data

(63) Continuation of application No. PCT/JP2017/027823, filed on Aug. 1, 2017.

(30) Foreign Application Priority Data

Aug. 18, 2016 (JP) ..... 2016-160618

(51) Int. Cl.
*A47C 3/00* (2006.01)
*A47C 3/026* (2006.01)
(Continued)

(52) U.S. Cl.
CPC ..... *A47C 3/026* (2013.01); *A47C 3/025* (2013.01); *A47C 3/30* (2013.01); *A47C 9/00* (2013.01);
(Continued)

(58) Field of Classification Search
CPC .... A61G 5/1075; A61G 5/1089; A61G 7/005; A61G 13/04; A61G 7/008
(Continued)

(56) References Cited

U.S. PATENT DOCUMENTS 4,099,697 A * 7/1978 Von Schuckmann ..... A47C 3/026 248/398
5,524,967 A * 6/1996 Glockl ..... A47C 3/02 248/372.1
6,209,843 B1 * 4/2001 Smith, Jr. ..... A47C 3/0252 248/346.01
6,834,916 B2 * 12/2004 Volkman ..... A47C 3/029 297/270.1
(Continued)

FOREIGN PATENT DOCUMENTS

JP 52-73805 U 6/1977
JP 54-91304 U 6/1979
(Continued)

OTHER PUBLICATIONS

International Search Report dated Oct. 24, 2017, issued in counterpart International Application No. PCT/JP2017/027823 (2 pages).

*Primary Examiner* — Steven M Marsh
(74) *Attorney, Agent, or Firm* — Westerman, Hattori, Daniels & Adrian, LLP

(57) ABSTRACT

A tiltable stool includes a seat support, a seat, and a tilt mechanism. The seat is mounted to an upper end of the seat support. The tilt mechanism allows the seat to tilt in a desired direction. The tilt mechanism includes a coiled wave spring, an upper spring retainer and a lower spring retainer, a fastener bolt, and a tilt limiter. The upper spring retainer and the lower spring retainer are disposed opposite each other to sandwich the coiled wave spring therebetween. The fastener bolt pivotably holds the upper spring retainer in position. The tilt limiter is disposed inside the coiled wave spring and is secured to either one of the spring retainers. The tilt limiter includes a conical surface thereon which contacts a contact surface when the seat tilts to a predeter-
(Continued)

mined tilt angle. The upper spring retainer is secured to a lower end of the seat support.

8 Claims, 14 Drawing Sheets

(51) Int. Cl.

| | |
|---|---|
| ***A47C 3/025*** | (2006.01) |
| ***A47C 3/30*** | (2006.01) |
| ***A47C 9/00*** | (2006.01) |
| ***A47C 9/02*** | (2006.01) |
| *A47C 3/40* | (2006.01) |

(52) U.S. Cl.
CPC ..... *A47C 9/025* (2013.01); *A47C 3/0252* (2013.01); *A47C 3/40* (2013.01)

(58) Field of Classification Search
USPC ..... 248/371, 398; 297/313, 314, 325
See application file for complete search history.

(56) References Cited

U.S. PATENT DOCUMENTS

| | | | | |
|---|---|---|---|---|
| 7,533,506 | B2 * | 5/2009 | Platt | E04H 12/2261 52/296 |
| 2005/0218707 | A1 * | 10/2005 | Suhr | A47C 3/026 297/344.1 |
| 2006/0138840 | A1 * | 6/2006 | Keilhauer | A47C 3/02 297/344.1 |
| 2011/0175414 | A1 * | 7/2011 | Asbjomsen | A47C 9/002 297/313 |
| 2012/0025573 | A1 | 2/2012 | Lin | |

FOREIGN PATENT DOCUMENTS

| | | | |
|---|---|---|---|
| JP | 56-137657 | U | 10/1981 |
| JP | 2007-7249 | A | 1/2007 |
| JP | 2007-268118 | A | 10/2007 |
| JP | 3165162 | U | 1/2011 |
| JP | 2015-192825 | A | 11/2015 |
| JP | 2015-202343 | A | 11/2015 |

* cited by examiner

TILTABLE STOOL AND TILTABLE LOUNGE CHAIR

CROSS-REFERENCE TO RELATED APPLICATIONS

The present patent application is a continuation of International Application No. PCT/JP2017/027823, filed Aug. 1, 2017, which claims priority to Japanese Application No. 2016-160618, filed Aug. 18, 2016, both of which are incorporated herein by reference in their entireties.

BACKGROUND OF THE INVENTION

Field of the Invention

The present invention relates to a chair, and more particularly to a tiltable stool and tiltable lounge chair, which include a tilt mechanism disposed near a floor to allow a seat to tilt in a desired direction.

Background Art

A backless seat for one person is called a stool. Various types of stools are known in the art. Recently, tiltable stools have been proposed which have seats that can tilt in a desired direction. Two categories of tiltable chairs are those with the tilt mechanism located directly below the seat, and those with the tilt mechanism located near a floor. An example of the latter is disclosed in Patent Literature 1.

Patent Literature 1 describes a tiltable stool in which a seat is mounted onto an upper end of a support column with a gas spring cylinder inserted inside the column. The stool includes a first pivot link that securely fits around the column, a substrate plate affixed to the first pivot link, and a second pivot link rotatably supported on a base. The second pivot link axially supports the first pivot link, so that the first pivot link freely rotates in two mutually perpendicular directions. The stool also includes a plurality of coil springs, each extending between the base and the substrate plate.

LIST OF RELATED ART REFERENCE

Patent Literature 1: JP 2007-268118 A

BRIEF SUMMARY

Patent Literature 1 proposes connecting the support column to the base which supports the weight of the stool, with the first and second pivot links radially supporting the support column. Such a structure prevents the elastic components from being directly loaded with the body weight of a seated user, which allows for reduced resistance in the elastic components and smooth pivoting of the stool.

To accomplish the above capability, the stool requires use of the first and second pivot links for universal movement as well as a total of six coil springs. Thus, the tilt mechanism involves a complicated structure formed of a large number of components, which not only adds to high manufacturing costs, but also results in variations in tilting motion depending on the orientation in which the stool is inclined. In addition, since the stool lacks any capability to change a maximum tilt angle, an individual seated on the stool might experience discomfort or a risk of accidental fall results due to excessive tilt angle.

The present invention provides a tiltable chair, such as a stool and a lounge chair, which includes a simple, compact tilt mechanism for tilting a seat in a desired direction, while allowing a seated user to readily adjust a maximum tilt angle.

In one embodiment, a tiltable stool includes a seat support column, a seat, and a tilt mechanism. The seat support column includes a gas spring disposed inside. The seat is mounted to an upper end of the support column. The tilt mechanism is disposed adjacent to a floor to allow the seat to tilt in a desired direction. The tilt mechanism includes a coiled wave spring, an upper spring retainer and a lower spring retainer, a fastener bolt, and a tilt limiter. The upper spring retainer and the lower spring retainer are disposed opposite each other to sandwich the coiled wave spring therebetween. The fastener bolt is disposed at an approximate center of the upper spring retainer to pivotably hold the upper spring retainer in position. The tilt limiter is disposed inside the coiled wave spring and secured to either the upper spring retainer or the lower spring retainer. The tilt limiter includes a conical surface thereon, which contacts a contact surface when the seat tilts to a predetermined tilt angle. The upper spring retainer is secured to a lower end of the seat support column.

Specifically, in the above embodiment, the gas spring allows for vertical adjustment, in which the stool height is varied by extending and shortening the seat support column. Although general stool height may be optimized according to a particular application, provision of the gas spring is particularly desirable for a tall tiltable stool. The gas spring is rotatably installed. Where the seat involves a directional functionality, the gas spring may include an automatic position recovery system to recover an original rotational position as necessary.

As mentioned earlier, in the tilt mechanism, the upper spring retainer and the lower spring retainer are disposed opposite each other to sandwich the coiled wave spring therebetween. The fastener bolt is disposed at an approximate center of the upper spring retainer to pivotably hold the upper spring retainer in position. The tilt limiter is disposed inside the coiled wave spring and is secured to either the upper spring retainer or the lower spring retainer. The lower spring retainer may be secured to a base which is placed on the floor. The upper spring retainer is secured to the lower end of the seat support column.

A definition of the coiled wave spring is set forth in the Japan Spring Manufacturers Association (JSMA) standard No. SB009: a compression coiled spring formed by processing a flat metal wire into a coiled configuration with a series of waves added in a direction of length of the metal wire.

In another embodiment, the tiltable stool further includes an elastic member disposed between the upper spring retainer and the lower spring retainer to exert a biasing force upon tilting of the seat.

Provision of the elastic member is desirable where a biasing force higher than that accomplished solely with the coiled wave spring is required, so as to, for example, promote a user comfort of seating. Examples of the elastic member may include a solid rubber and a coiled spring.

Preferably, the tiltable stool may include a convex spherical surface formed around the fastener bolt, and a concave spherical surface operably connected to either the upper spring retainer or the lower spring retainer. The convex spherical surface is slidable against the concave spherical surface, so that the upper spring retainer inclines as the coiled wave spring deforms upon tilting of the seat.

The concave spherical surface may be provided in an appropriate structure adjacent to either the upper spring retainer or the lower spring retainer. Where the concave spherical surface is disposed adjacent to the upper spring retainer, the fastener bolt does not incline in response to inclination of the upper spring retainer. Contrarily, where the concave spherical surface is disposed adjacent to the lower spring retainer, the fastener bolt inclines in sync with the upper spring retainer.

In yet another embodiment, a tiltable stool includes a seat support, a seat, a tilt mechanism, and a rotary member. The seat is mounted to an upper end of the seat support. The tilt mechanism is disposed adjacent to a floor to allow the seat to tilt in a desired direction. The tilt mechanism includes a coiled wave spring, an upper spring retainer, a lower spring retainer, a fastener bolt, and a tilt limiter. The upper spring retainer and the lower spring retainer are disposed opposite each other to sandwich the coiled wave spring therebetween. The fastener bolt is disposed at an approximate center of the upper spring retainer to pivotably hold the upper spring retainer in position. The tilt limiter is disposed inside the coiled wave spring and is secured to either the upper spring retainer or the lower spring retainer. The tilt limiter includes a conical surface thereon which contacts a contact surface when the seat tilts to a predetermined tilt angle. The upper spring retainer is secured to a lower end of the seat support. The rotary member is connected to a bottom of the lower spring retainer. The seat support includes either a column of a fixed length or a hollow, generally cylindrical body.

Specifically, the tiltable stool in the above embodiment may have a fixed height. Further, the tilt mechanism may be connected to the base via the rotary member.

Where the stool height is 500 millimeters (mm) or greater, the seat support may have its upper end secured to the seat, and lower end secured to the upper spring retainer of the tilt mechanism. Where the stool height is lower and/or where the seat support comprises a hollow, generally cylindrical body, the seat support may have its upper end secured to the seat, and lower end secured to the upper spring retainer of the tilt mechanism, with the lower spring retainer secured to a base via the rotary member.

More specifically, the rotary member serves to allow rotation of the lower spring retainer relative to a central axis defined by the coiled wave spring. Examples of the rotary member include, but are not limited to, a thrust bearing.

Provision of the rotary member reduces torque acting on the coiled wave spring where, as is typical with a stool, a user's body movement imparts not only tilting but also twisting force to the seat.

In yet another embodiment, the seat support comprises a hollow, generally cylindrical body which defines an opening at the upper end thereof and an inner compartment to accommodate an article therein. The seat comprises either a removable seat or a stationary seat. The removable seat is removably attached to the upper end of the seat support to open and close the opening thereof. The stationary seat is fixedly attached to the upper end of the seat support, wherein multiple openings are provided on one or more sides of the hollow, generally cylindrical body.

Specifically, the seat support is not limited to a straight cylinder having a constant diameter identical to that of the outer circumference of the seat. Examples of the seat support may include any generally cylindrical body, such as an upwardly tapered cylinder or a waisted cylinder having a narrower diameter at its center. Also, the seat support may have a multi-faceted or polygonal shape for aesthetic or other purposes.

In yet another embodiment, a tiltable lounge chair includes a seat support, a seat, a tilt mechanism, a rotary member, and a base. The seat is mounted on the seat support. The tilt mechanism is disposed adjacent to a floor to allow the seat to tilt in a desired direction. The tilt mechanism includes a coiled wave spring, an upper spring retainer and a lower spring retainer, a fastener bolt, and a tilt limiter. The upper spring retainer and the lower spring retainer are disposed opposite each other to sandwich the coiled wave spring therebetween. The fastener bolt is disposed at an approximate center of the upper spring retainer to pivotably hold the upper spring retainer in position. The tilt limiter is disposed inside the coiled wave spring and is secured to either the upper spring retainer or the lower spring retainer. The tilt limiter includes a conical surface thereon which contacts a contact surface when the seat tilts to a predetermined tilt angle. The upper spring retainer is secured to a lower end of the seat support. The rotary member is connected to a bottom of the lower spring retainer. The base serves to mount the lower spring retainer thereon, with the rotary member interposed between the base and the lower spring retainer. The seat support includes either a generally U-shaped frame or a seat stand. The generally U-shaped frame includes a bottom side extending below the seat, a pair of opposed lateral sides each extending upward from the bottom side, and a pair of armrests disposed on distal ends of the pair of opposed lateral sides. The seat stand is secured a bottom of the seat, wherein the seat includes an integral backrest extending therefrom.

The tiltable lounge chair may be configured as a chair for a single person to lounge thereon. The tiltable lounge chair can be inclined and swiveled in a desired direction.

The maximum tilt angle of the seat may be varied depending on the direction of tilt. For example, in case of a lounge chair having a backrest on a rear side, the conical surface of the tilt limiter may be modified so as to establish a smaller maximum angle for rearward tilt than those for forward and lateral tilt. However, in case of a round stool that does not include a directional component, the maximum tilt angle may be constant regardless of the direction of tilt.

Preferably, the maximum tilt angle is adjustable so as to accommodate different body sizes, ages and sexes of the individual users. In such cases, a seated user may be allowed to select an optimal angle ranging up to the maximum tilt angle established where the conical surface of the tilt limiter strikes the contact surface.

To provide tilt angle adjustment, in yet another embodiment, the tiltable stool further includes a rotatable flange ring, multiple radially disposed stoppers, and a tilt angle adjustment lever. The rotatable flange ring is disposed outside and concentrically with the coiled wave spring. The rotatable flange ring includes four radially disposed sets of multi-level flange surfaces circumferentially arranged in series. The multiple stoppers are secured to a bottom surface of the upper spring retainer. The tilt angle adjustment lever is operably connected to the rotatable flange ring to rotate the rotatable flange ring therewith. A maximum tilt angle of the seat is adjustable by rotating the rotatable flange ring to position the flange surface of a particular height to meet one of the multiple stoppers.

The tilt angle adjustment may be provided with a suitable structure to facilitate rotation of the rotatable flange ring. Examples of such structure include, but are not limited to, a guide member along which the rotatable flange ring is slidably rotated.

The number of the maximum tilt angles established by the above mechanism may be 2 to 4.

As used herein, the term "four radially disposed sets of multi-level flange surfaces" refers to a configuration in which the rotatable flange ring has four quadrant sections each including a single set of raised surfaces of different heights defined therein which are circumferentially arranged in series. With the four sets of multi-level flange surfaces radially distributed, the stoppers contact the flange surfaces of a particular height when the maximum tilt angle is reached regardless of the direction of tilt.

The maximum tilt angle is established by rotating the rotatable flange ring to an operational position where the flange surfaces of a particular height are located immediately below the stoppers.

To facilitate positioning of the rotatable flange ring, in yet another embodiment, the tiltable stool further includes a positioning mechanism to guide and retain the rotatable flange ring in position. The positioning mechanism includes a guide groove, multiple positioning holes, and a spring-loaded ball lock. The guide groove is formed in an outer circumference of the rotatable flange ring to guide the rotatable flange ring while changing the maximum tilt angle. The multiple positioning holes are defined adjacent to the guide groove in the outer circumference of the rotatable flange ring. The spring-loaded ball lock is disposed around the outer circumference of the rotatable flange ring. The spring-loaded ball lock engages one of the multiple positioning holes to hold the rotatable flange ring in position when the maximum tilt angle of the seat is established.

Resistance against tilt of the seat can affect the comfort of seating. The tilt resistance may be adjusted, for example, by changing the mounting configuration of the coiled wave spring, that is, spacing between the upper spring retainer and the lower spring retainer between which the coiled wave spring is retained.

To provide tilt resistance adjustment, in yet another embodiment, the tiltable stool further includes a nut and a tilt resistance adjustment lever. The nut serves to screw the fastener bolt therethrough. The nut is secured to either an approximate center of an upper surface of the upper spring retainer or an approximate center of a bottom surface of the lower spring retainer. The tilt resistance adjustment lever is operably connected to a distal end of the fastener bolt to rotate the fastener bolt therewith. A tilt resistance of the coiled wave spring is adjustable by rotating the fastener bolt to change a distance between the upper spring retainer and the lower spring retainer.

Where the fastener bolt is disposed with its head oriented upward, the tilt resistance adjustment lever may be provided below the lower spring retainer. In that case, a base of the tiltable stool may have a raised middle portion, so as to provide a sufficient space for the user to readily perform tilt resistance adjustment using the lever.

According to one aspect, a tiltable stool includes a seat support column, a seat, and a tilt mechanism. The seat support column includes a gas spring disposed inside. The seat is mounted to an upper end of the seat support column. The tilt mechanism is disposed adjacent to a floor to allow the seat to tilt in a desired direction. The tilt mechanism includes a coiled wave spring, an upper spring retainer and a lower spring retainer, a fastener bolt, and a tilt limiter. The upper spring retainer and the lower spring retainer are disposed opposite each other to sandwich the coiled wave spring therebetween. The fastener bolt is disposed at an approximate center of the upper spring retainer to pivotably hold the upper spring retainer in position. The tilt limiter is secured to the upper spring retainer. The tilt limiter contacts a contact surface when the seat tilts to a predetermined tilt angle. The upper spring retainer is secured to a lower end of the seat support column.

Such an aspect allows for a simple, compact structure for the tilt mechanism, which does not necessitate trunnions or universal movement components as in a conventional system. Further, the tiltable stool accomplishes an improved comfort of seating due in part to the tilt mechanism enabling uniform, consistent inclination regardless of the direction of tilt.

According to another aspect, a tiltable stool includes a seat support, a seat, a tilt mechanism, and a rotary member. The seat is mounted to an upper end of the seat support. The tilt mechanism is similar to that described above. The upper spring retainer is secured to a lower end of the seat support. The rotary member is connected to a bottom of the lower spring retainer. The seat support comprises a fixed length structure that does not have a vertical adjustment capability. The lower spring retainer is secured to a base via the rotary member interposed therebetween.

Such an aspect reduces torque acting on the coiled wave spring, thereby allowing for greater durability. Further, the tiltable stool accomplishes greater functionality where the seat support comprises a hollow, generally cylindrical body which provides an inner comportment to accommodate an article therein.

According to yet another aspect, a tiltable lounge chair includes a seat support, a seat, a tilt mechanism, and a rotary member. The seat is mounted to an upper end of the seat support. The tilt mechanism is similar to that described above. The upper spring retainer is secured to a lower end of the seat support. The rotary member is connected to a bottom of the lower spring retainer. The seat support comprises a generally U-shaped frame or a seat stand. The lower spring retainer is secured to a base via the rotary member interposed therebetween.

Such an aspect provides a lounge chair with a special capability of tilting and free rotation in a desired direction.

BRIEF DESCRIPTION OF THE DRAWINGS

The invention is better understood by reading the following detailed description with reference to the accompanying drawing figures, in which like reference numerals refer to like elements throughout, and in which.

DETAILED DESCRIPTION

Figure 1:
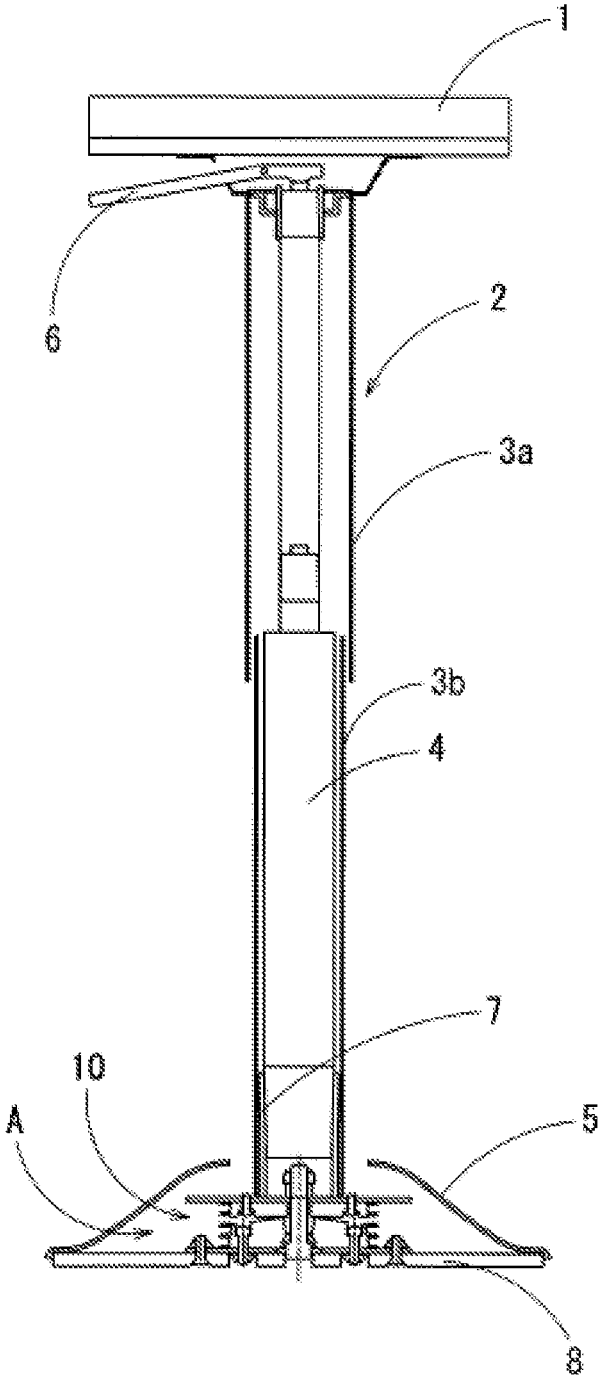
FIG. 1 is a front cross-sectional view depicting an overall structure of a tiltable stool according to one embodiment of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Referring now to the drawings, in which corresponding parts are identified with the same reference numeral, a tiltable stool according to one embodiment is described.

Figure 2:
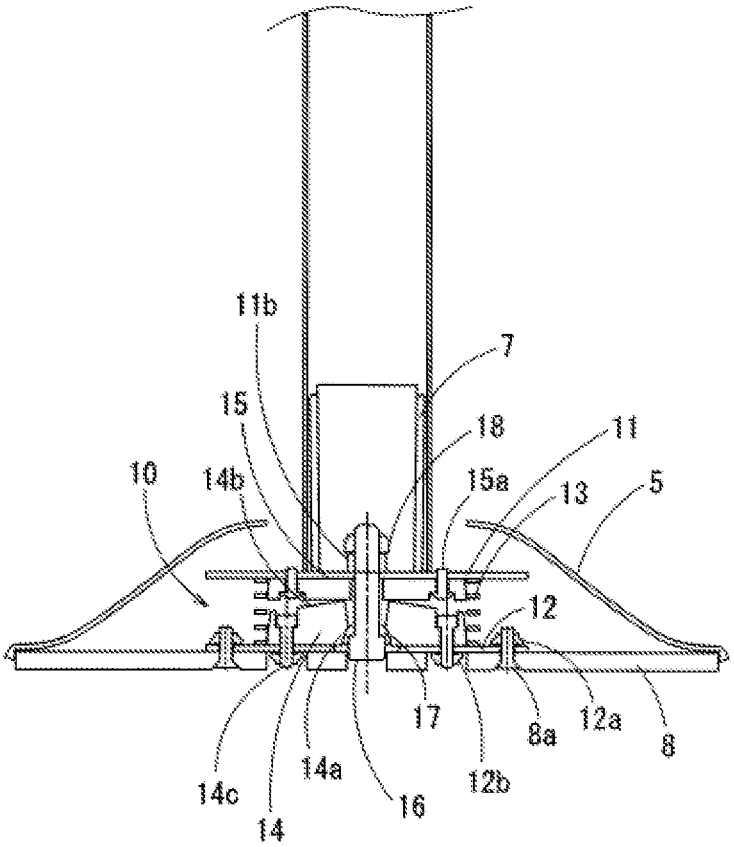
FIG. 2 is an enlarged view of section A of FIG. 1.
Figure 3:
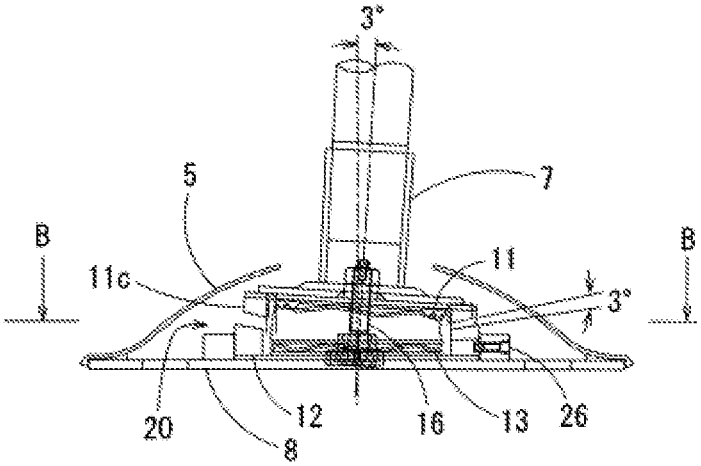
FIG. 3 is a fragmentary, cross-sectional view of the tiltable stool, shown inclined 3 degrees from an upright position, in which a maximum tilt adjuster is provided.
Figure 4:
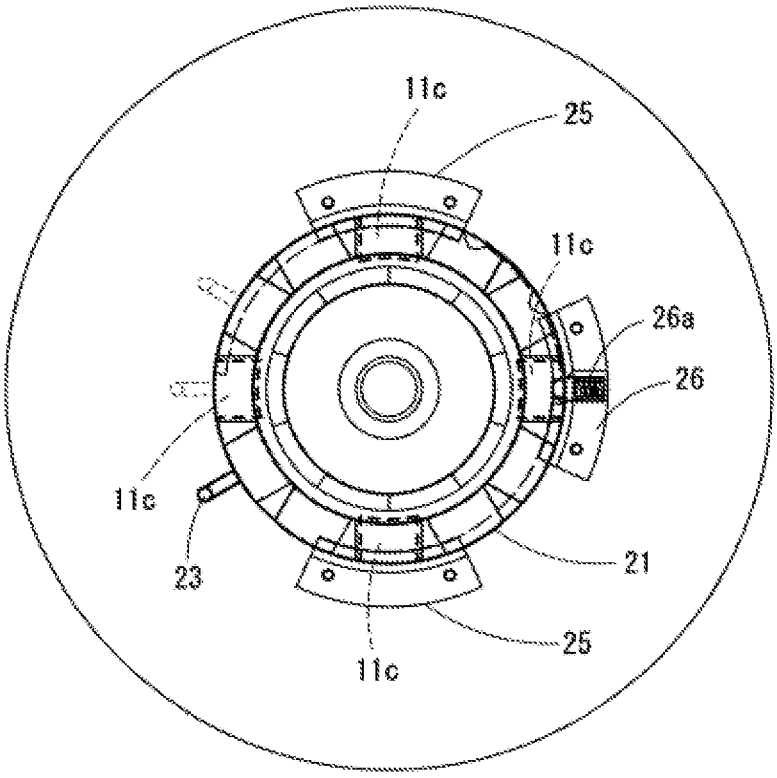
FIG. 4 is a cross-sectional view taken along lines B-B of FIG. 3.
Figure 5:
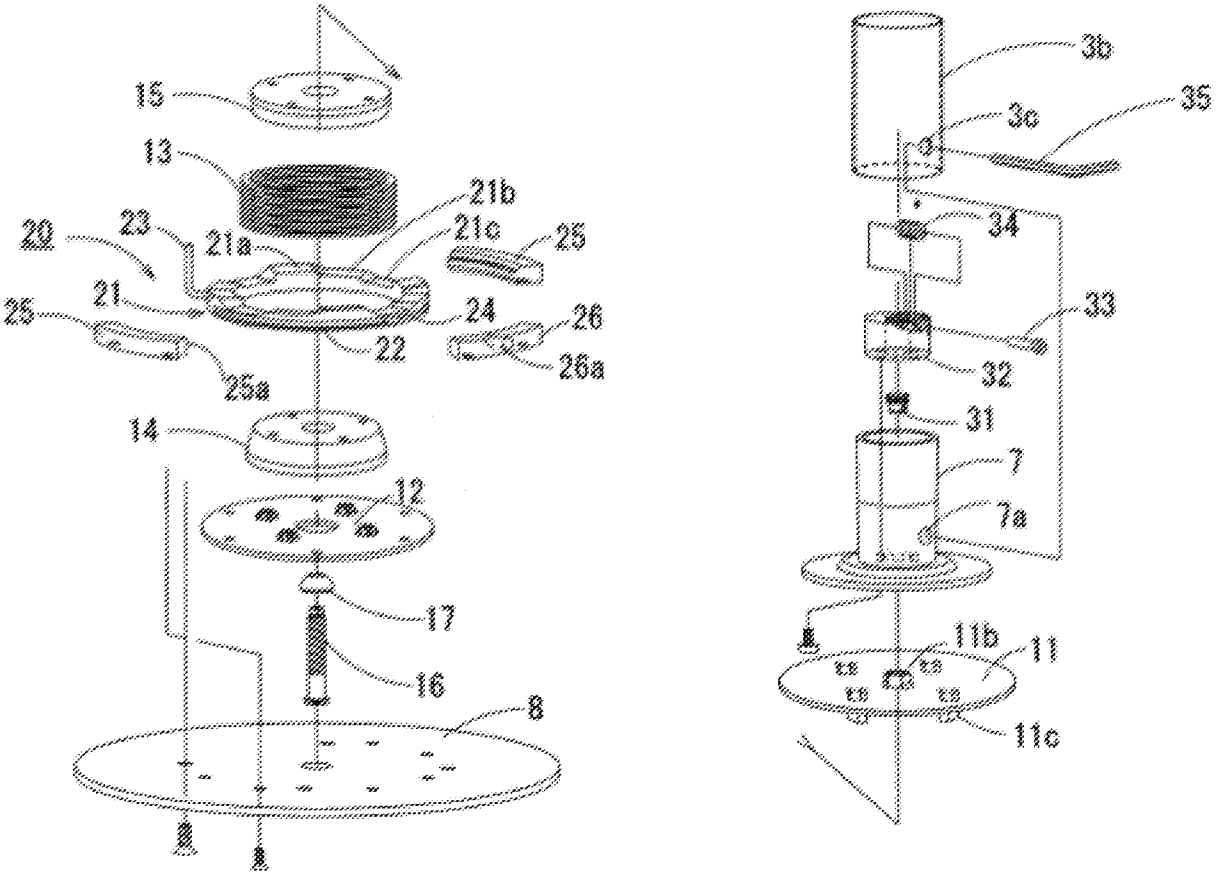
FIG. 5 is an exploded perspective view of a tilt mechanism and the maximum tilt adjuster.
Figure 6:
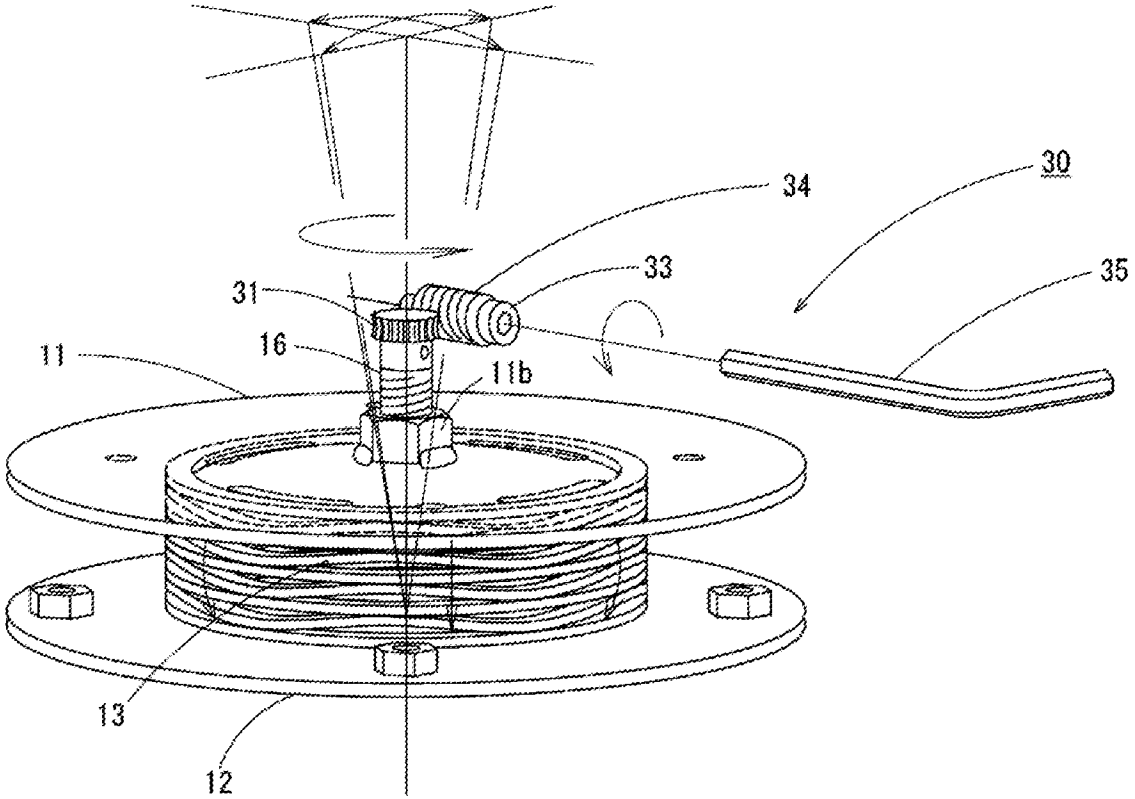
FIG. 6 is a fragmentary perspective view schematically illustrating adjustment of a tilt resistance in a coiled wave spring.

FIG. 1 is a front cross-sectional view depicting an overall structure of the tiltable stool. FIG. 2 is an enlarged view of section A of FIG. 1. FIG. 3 is a fragmentary, cross-sectional view of the tiltable stool, in which a maximum tilt adjuster is provided. FIG. 4 is a cross-sectional view taken along lines B-B of FIG. 3. FIG. 5 is an exploded perspective view of a tilt mechanism, the maximum tilt adjuster, and a tilt resistance adjuster. FIG. 6 is a fragmentary perspective view schematically illustrating adjustment of a tilt resistance in a coiled wave spring.

With reference to FIGS. 1 through 6, the tiltable stool includes a seat 1 rotatably mounted to an upper end of a seat support column 2. A lower end of the column 2 is connected to a base 8 via a tilt mechanism 10. A gas spring 4 including a pneumatic cylinder is accommodated inside the column 2. The gas spring 4 is operably connected to a height adjustment lever 6 disposed below the seat 1. Manipulating the lever 6 activates the gas spring 4 to raise and lower the seat 1. A pair of upper and lower telescopic covers 3*a* and 3*b* are disposed around the gas spring 4. In the present embodiment, the stool has an overall height of 840 mm, with a vertical adjustment stroke of 260 mm.

The tilt mechanism 10 includes an upper spring retainer 11 and a lower spring retainer 12 disposed opposite each other to sandwich a coiled wave spring 13 disposed between the upper spring retainer 11 and the lower spring retainer 12. A fastener bolt 16 passes through an opening formed in an approximate center of each of the upper spring retainer 11 and the lower spring retainer 12 to hold together the components of the tilt mechanism 10.

The tilt mechanism 10 also includes a tilt limiter 14 and a contact member 15 each disposed radially inside the coiled wave spring 13. The tilt limiter 14 includes a conical surface 14*b* on an upper side thereof. The contact member 15 includes a planar contact surface on a bottom side thereof. The contact member 15 is positioned above the tilt limiter 14, so that the tilt limiter conical surface 14*b* faces the planar contact surface. One or more bolts 14*c* secure the tilt limiter 14 in position onto the lower spring retainer 12. One or more bolts 15*a* secure the contact member 15 in position onto the upper spring retainer 11.

The tilt limiter 14 and the contact member 15 each comprise a generally annular member with an opening at a center thereof. An outer circumference of each of the tilt limiter 14 and the contact member 15 defines a guide surface for the coiled wave spring 13. The fastener bolt 16 is inserted from below into the central openings of the tilt limiter 14 and the contact member 15, and then through a securing nut 11*b* affixed to the upper spring retainer 11. Thus, the fastener bolt 16 is mounted with its head oriented downward. A ball member 17 defining a convex spherical surface is disposed around a shoulder of the fastener bolt 16. A concave spherical surface 14*a* is formed in the tilt limiter 14 to engage the convex spherical surface of the ball member 17. A nut 18 is provided to limit rotation of the bolt 16.

In operation, the tilt mechanism 10 allows the stool to tilt in response to a user's shifting of weight. Specifically, where a seated user leans to one side to apply load in a given direction, the coiled wave spring 13 deflects as the column 2 inclines and the upper spring retainer 11 tips sideways. Such displacement causes the fastener bolt 16 to slant from its upright position, with the convex spherical surface of the ball member 17 sliding against the concave spherical surface 14*a* of the tilt limiter 14.

When the seat 1 is inclined to a prescribed tilt angle (for example, 8 degrees in the present embodiment), the conical surface 14*b* of the tilt limiter 14 abuts the contact surface of the contact member 15, thereby limiting further tilt of the seat 1 beyond the prescribed tilt angle.

The tilt angle of the seat 1 may be controlled by the configuration of the tilt limiter 14, for example, so as to decrease the risk of fall. In the present embodiment, the conical surface 14*b* is configured to touch the contact surface of the contact member 15 where a tilt angle of 8 degrees is reached.

In a further embodiment, the stool may include a maximum tilt angle adjuster 20 (omitted for simplicity in FIGS. 1 and 2) to adjust a maximum tilt angle to suit individual needs and preferences. An embodiment of the maximum tilt angle adjuster 20 is depicted below, wherein the tilt angle is adjustable to 6, 4.5, and 3 degrees by a user while seated.

With reference to FIGS. 3 through 5, the maximum tilt angle adjuster 20 includes a rotatable flange ring 21 disposed radially outside, and concentrically with, the coiled wave spring 13 and multiple radially disposed stoppers 11*c* secured to a bottom surface of the upper spring retainer 11. A pair of ring guides 25, each having a guide rib 25*a* extending therefrom, are disposed adjacent to an outer circumference of the flange ring 21. A positioning mechanism including a positioning member 26 is provided to guide and retain the rotatable flange ring 21 in position.

The rotatable flange ring 21 includes a pair of guide grooves 22 formed along an outer circumferential edge thereof. The flange ring 21 rotates with respect to the stoppers 11*c* while being guided with the guide ribs 25*a* sliding inside the guide grooves 22. A tilt angle adjustment lever 23 extends outward from the flange ring 21, which allows a user to manually operate the flange ring 21 to rotate.

The rotatable flange ring 21 further includes radially disposed, four sets of multi-level flange surfaces. Specifically, the flange ring 21 in the present embodiment includes four sets of a first flange surface 21*a*, a second flange surface 21*b*, and a third flange surface 21*c* which have different heights from each other. The flange surfaces 21*a*, 21*b*, and 21*c* are arranged circumferentially in series on an upper surface of the flange ring 21. Each set of the flange surfaces 21*a*, 21*b*, and 21*c* are oriented 90 degrees relative to the adjacent ones.

In operation, a maximum tilt angle of the seat 1 is adjustable by rotating the rotatable flange ring 21 to position the flange surface 21*a*, 21*b*, and 21*c* of a particular height to meet one of the multiple stoppers 11*c*. Specifically, the first flange surface 21*a* contacts a stopper 11*c* where the maximum tilt angle is set to 3 degrees. The second flange surface 21*b* contacts a stopper 11*c* where the maximum tilt angle is set to 6 degrees. The third flange surface 21*c* contacts a stopper 11*c* where the maximum tilt angle is set to a given angle not less than 8 degrees (for example, 10 degrees in the present embodiment). Where the third flange surface 21*c* is selected, the tilt limiter 14 contacts the contact member 15 to limit tilting of the seat 1 at the tilt angle of 8 degrees, as mentioned earlier.

The pair of ring guides 25 each comprises a circular arc piece. Each ring guide 25 is disposed adjacent to the outer circumference of the flange ring 21, with the guide rib 25*a* fitting inside the guide groove 22.

The positioning member 26 is shaped in a circular arc similar to that of the ring guide 25. The positioning member 26 is disposed adjacent to the outer circumference of the flange ring 21. The positioning member 26 includes a spring-loaded ball lock 26*a* consisting of a ball and a spring. A positioning guide 24 including a guide groove and multiple positioning holes is disposed in the outer circumferential edge of the flange ring 21.

The spring-loaded ball lock 26*a* engages one of the multiple positioning holes to hold the rotatable flange ring 21 in position where the maximum tilt angle of the seat 1 is established, that is, where the flange surface 21*a*, 21*b*, and 21*c* corresponding to a desired tilt angle reaches directly below a stopper 11*c*.

In operation, the maximum tilt angle adjuster 20 varies the maximum tilt angle in response to a user manipulating the lever 23. Specifically, a seated user can lean to one side to tilt the seat 1 to a maximum tilt angle. Where the default angle is not adequate, the user can turn the lever 23 to change the maximum tilt angle to a different level.

More specifically, turning the lever 23 causes the flange ring 21 to rotate, which in turn causes the multi-level flange surfaces 21*a*, 21*b*, and 21*c* to consecutively meet a stopper 11*c*. Once a given flange surface reaches its operational position (i.e., directly below a stopper 11*c*), the ball lock 26*a* engages the hole of the positioning guide 24 to fasten the flange ring 21 in position. If the tilt angle thus set does not suit the user's physique, the user can further turn the lever 23 to rotate the flange ring 21 to change the maximum tilt angle.

In a further embodiment, the tiltable stool may include a tilt resistance adjuster 30 to adjust a tilt resistance of the spring 13, which can be dictated by an amount of force required to cause displacement of the seat 1.

FIG. 6 schematically illustrates tilt resistance adjustment using the adjuster 30, shown with the maximum tilt angle adjuster 20 omitted for clarity.

As depicted in FIG. 6, the tilt resistance adjuster 30 adjusts the elastic stiffness by changing a distance or spacing between the upper spring retainer 11 and the lower spring retainer 12 where the coiled wave spring 13 is retained. In the present embodiment, the tilt resistance adjustment is performed by tightening and loosening the fastener bolt 16, which is screwed through the securing nut 11*b* secured to an approximate center of the upper surface of the upper spring retainer 11.

Specifically, the tilt resistance adjuster 30 includes a worm wheel 31 attached to the upper, distal end of the fastener bolt 16, and a worm 34 threaded on a worm shaft 33 to mesh with the worm wheel 31. A hexagonal socket is cut in the worm shaft 33 to receive a tilt resistance adjustment lever or hex key 35 to operate the worm drive.

With reference to FIG. 5, the worm wheel 31, the worm shaft 33, and the worm 34 are accommodated in a gear case 32. The gear case 32 is surrounded by a bracket 7 disposed on the upper spring retainer 11, with the lower cover 3*b* enclosing the bracket 7. Through-holes 7*a* and 3*c* are provided in the bracket 7 and the lower cover 3*b*, respectively, to insert the hex key 35 therethrough.

In operation, the tilt resistance adjuster 30 allows a user to adjust tilt resistance by turning the worm shaft 33 with the hex key 35, which in turn revolves the fastener bolt 16 to raise and lower the upper spring retainer 11. Lowering the upper spring retainer 11 increases the tilt resistance exhibited by the coiled wave spring 13, resulting in reduced tilt of the seat 1 for a given load applied. Contrarily, raising the upper spring retainer 11 decreases the tilt resistance exhibited by the coiled wave spring 13, resulting in increased tilt of the seat 1 for a given load applied.

Figure 7:
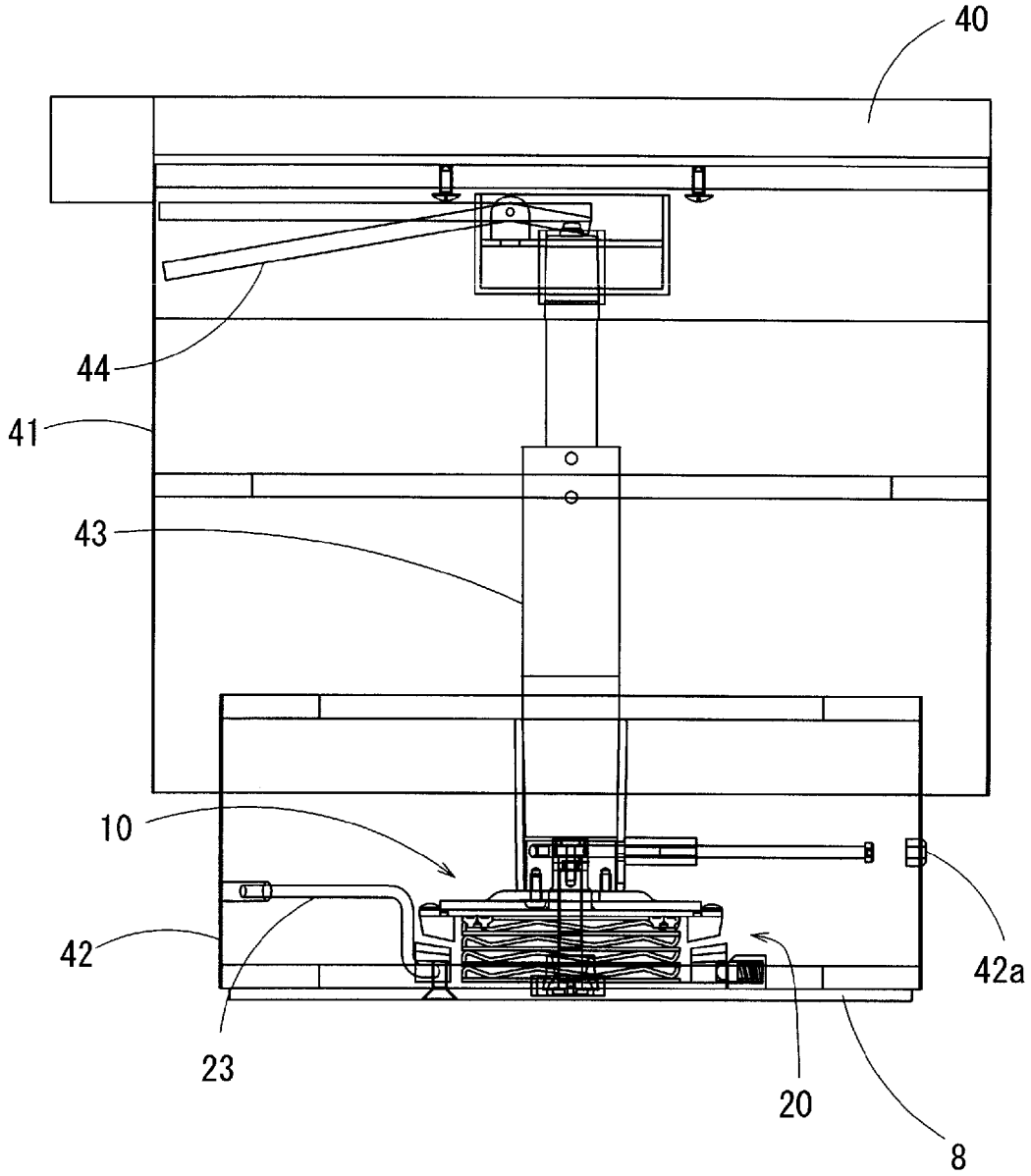
FIG. 7 is a cross-sectional view depicting an overall structure of a tiltable stool according to another embodiment.

FIG. 7 is a cross-sectional view depicting an overall structure of a tiltable and height-adjustable stool according to another embodiment.

With reference to FIG. 7, the overall structure of the tiltable stool is substantially identical to that depicted in FIGS. 1 through 6, except for the configuration of visible, external components.

Specifically, the tiltable stool includes a seat 40 mounted to an upper end of a seat support column including a gas spring 43 accommodated inside. The lower end of the gas spring 43 is connected to the base 8 via the tilt mechanism 10. The upper end of the gas spring 43 is connected to a height adjustment lever 44 to activate the gas spring 43 to raise and lower the seat 40. A pair of upper and lower, telescopic covers 41 and 42 are disposed around the gas spring 43, with the lower cover 42 smaller in diameter than the upper cover 41. A through-hole 42*a* is provided in the lower cover to allow insertion of the hex key 35 therethrough. In the present embodiment, the stool has an overall height of 400 mm, with a vertical adjustment stroke of 55 mm.

Further, the stool according to the present embodiment may be equipped with the maximum tilt angle adjuster 20 and the tilt resistance adjuster 30. Since the basic functionality and structure of these components are same as the embodiment depicted earlier, a further description is omitted for brevity.

In the present embodiment, where the seat 40 inclines, the upper cover 41 moves in sync with the seat movement, whereas the lower cover 42 remains stationary. Since the lower cover 42 has a large diameter compared to the previous embodiment, the tilt angle adjustment lever 23 and the tilt resistance adjuster 30 (with the hex key inserted through the through-hole 42*a*) each has an elongated configuration, so as to be accessible through the lower cover 42.

Variations of the tilt mechanism 10 are described below with reference to FIGS. 8 and 9.

Figure 8:
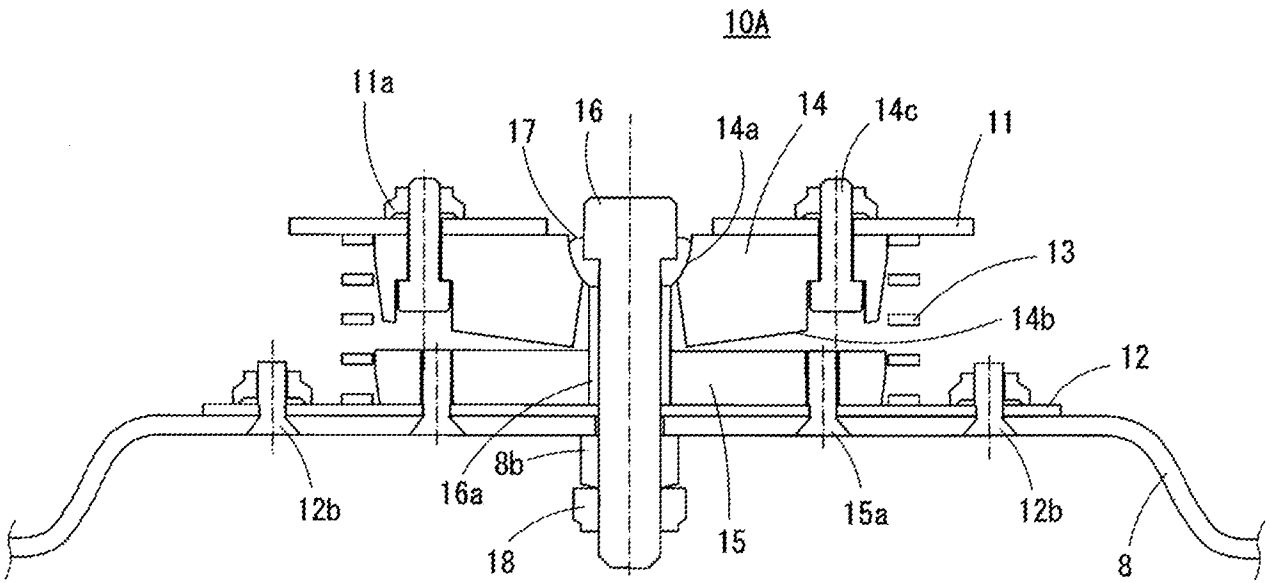
FIG. 8 is a fragmentary cross-sectional view of a tilt mechanism according to yet another embodiment.

FIG. 8 is a fragmentary cross-sectional view of a tilt mechanism 10A according to yet another embodiment.

As shown in FIG. 8, the tilt mechanism 10A includes an upper spring retainer 11 and a lower spring retainer 12 disposed opposite each other to sandwich a coiled wave spring 13 disposed between the upper spring retainer 11 and the lower spring retainer 12. A fastener bolt 16 passes through an opening formed in an approximate center of each of the upper spring retainer 11 and the lower spring retainer 12 to hold together the components of the tilt mechanism 10A.

The tilt mechanism 10A also includes a tilt limiter 14 and a contact member 15 each disposed radially inside the coiled wave spring 13. The tilt limiter 14 includes a conical surface 14*b* on a bottom side thereof. The contact member 15 includes a planar contact surface on an upper side thereof. The contact member 15 is positioned below the tilt limiter 14, so that the tilt limiter conical surface 14*b* faces the planar contact surface. One or more bolts 14*c* secure the tilt limiter 14 in position onto the upper spring retainer 11. One or more bolts 15*a* secure the contact member 15 in position onto the lower spring retainer 12.

The tilt limiter 14 and the contact member 15 each comprise a generally annular member with an opening at a center thereof. An outer circumference of each of the tilt limiter 14 and the contact member 15 defines a guide surface for the coiled wave spring 13. The fastener bolt 16 is inserted from above into the central openings of the tilt limiter 14 and the contact member 15, and then through a securing nut 8*b* affixed to the lower spring retainer 12. Thus, the fastener bolt 16 is mounted with its head oriented upward. A ball member 17 defining a convex spherical surface is disposed around a shoulder of the fastener bolt 16. A concave spherical surface 14*a* is formed in the tilt limiter 14 to engage the convex spherical surface of the ball member 17.

Additionally, a spacer collar 16*a* is disposed around the fastener bolt 16 to maintain a constant distance between the upper spring retainer 11 and the lower spring retainer 12. The collar 16*a* may be omitted where the tilt resistance adjuster 30 is provided.

The tilt mechanism 10A differs from the previous embodiment in that the fastener bolt 16 is disposed with its head oriented upward. The stool according to the present embodiment may be equipped with the maximum tilt angle adjuster 20 and the tilt resistance adjuster 30. Since the basic functionality and structure of these components are same as the embodiment depicted earlier, a further description is omitted for brevity.

In operation, the tilt mechanism 10A allows the stool to tilt in response to a user's shifting of weight. Specifically, where a seated user leans to one side to apply load in a given direction, the column 2 inclines causing the upper spring retainer 11 attached thereto to tip sideways. With the convex spherical surface of the ball member 17 sliding against the concave spherical surface 14*a* of the tilt limiter 14, the fastener bolt 16 remains stationary.

When the seat 1 is inclined to a prescribed tilt angle (for example, 8 degrees in the present embodiment), the conical surface 14*b* of the tilt limiter 14 abuts the contact surface of the contact member 15, thereby limiting further tilt of the seat 1 beyond the prescribed tilt angle.

Figure 9:
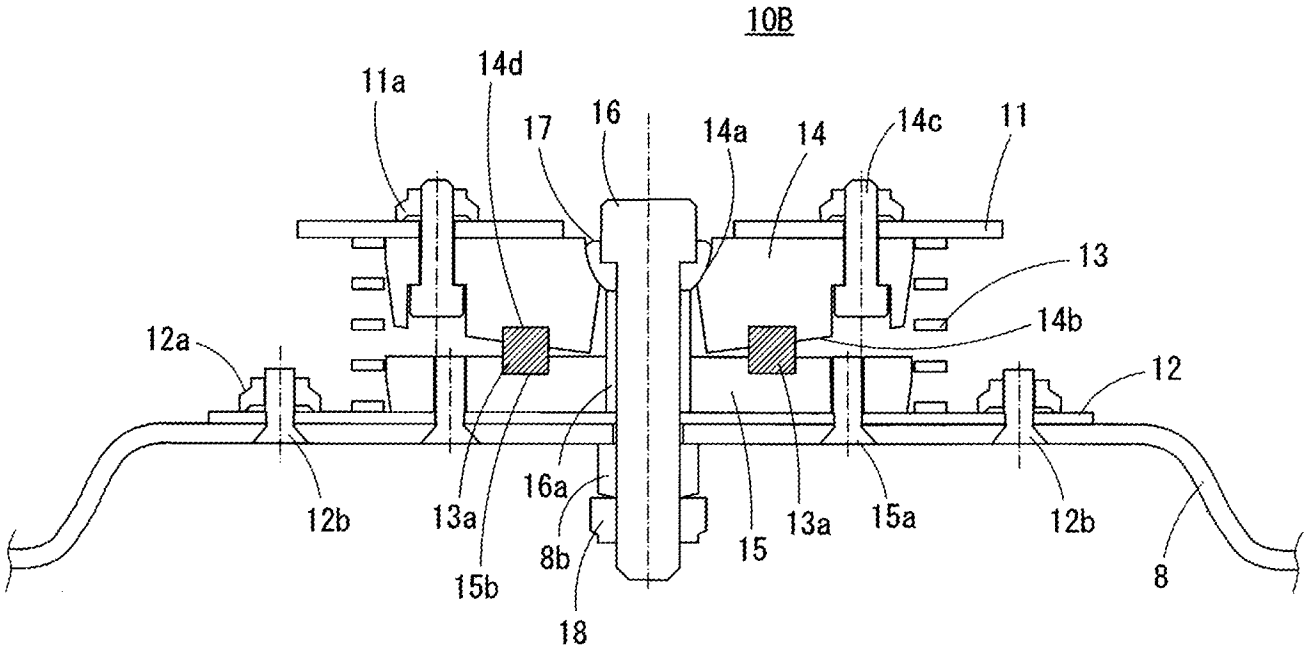
FIG. 9 is a fragmentary cross-sectional view of a tilt mechanism according to yet another embodiment, in which an elastic member is provided.

FIG. 9 is a fragmentary cross-sectional view of a tilt mechanism 10B according to yet another embodiment.

As shown in FIG. 9, the tilt mechanism 10B is substantially identical to the previous embodiment 10A, except that the mechanism 10B further includes an elastic member 13*a* disposed between the upper spring retainer 11 and the lower spring retainer 12 to exert a biasing force upon tilting of the seat 1.

Specifically, the elastic member 13*a* comprises a cylindrical piece of synthetic rubber sandwiched between the contact member 15 and the tilt limiter 14. An annular groove 15*b* is formed in the upper surface of the contact member 15 to support the elastic member 13*a* therein. Also, an annular groove 14*d* is formed in the bottom surface of the tilt limiter 14 to support the elastic member 13*a* therein.

Provision of the tilt mechanism 10B with the elastic member 13*a* enables increased elastic support as well as an improved, smooth feel upon tilting of the seat 1.

Figure 10:
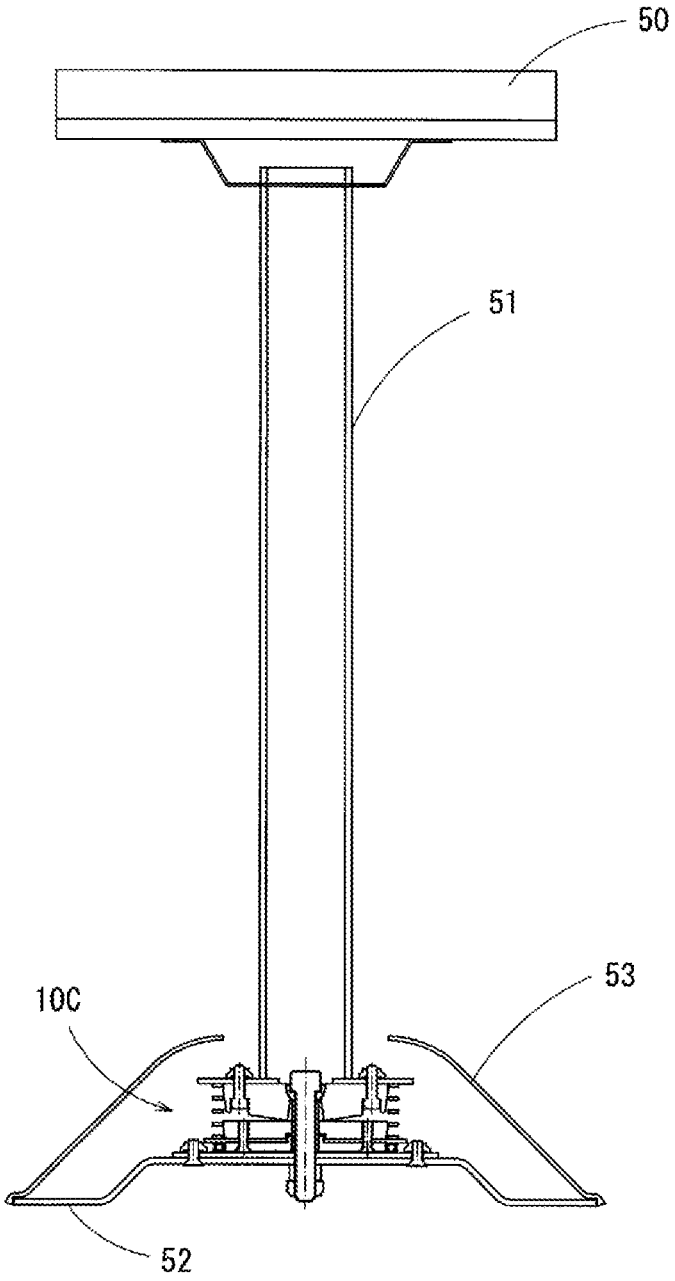
FIG. 10 is a cross-sectional view depicting an overall structure of a tiltable stool according to yet another embodiment.
Figure 11:
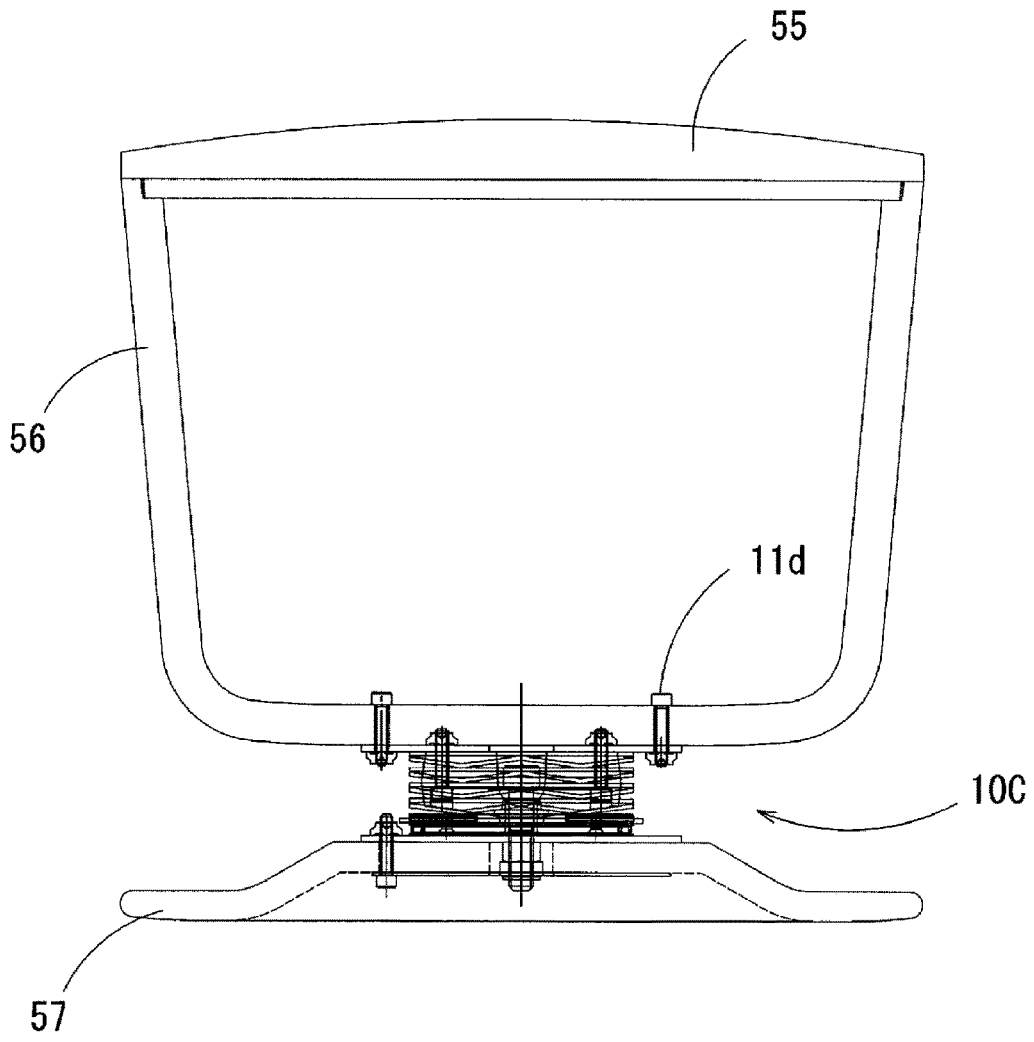
FIG. 11 is a cross-sectional view depicting an overall structure of a tiltable stool according to yet another embodiment.
Figure 12:
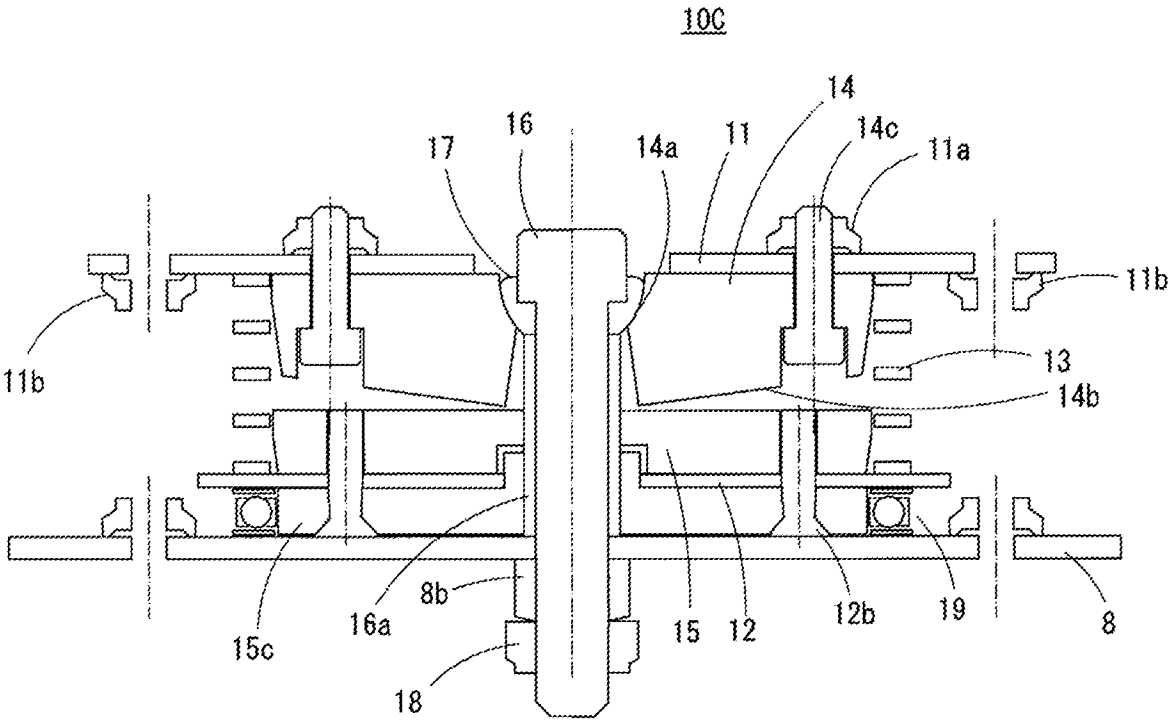
FIG. 12 is a detailed view of the tilt mechanism and a rotary member.
Figure 13:
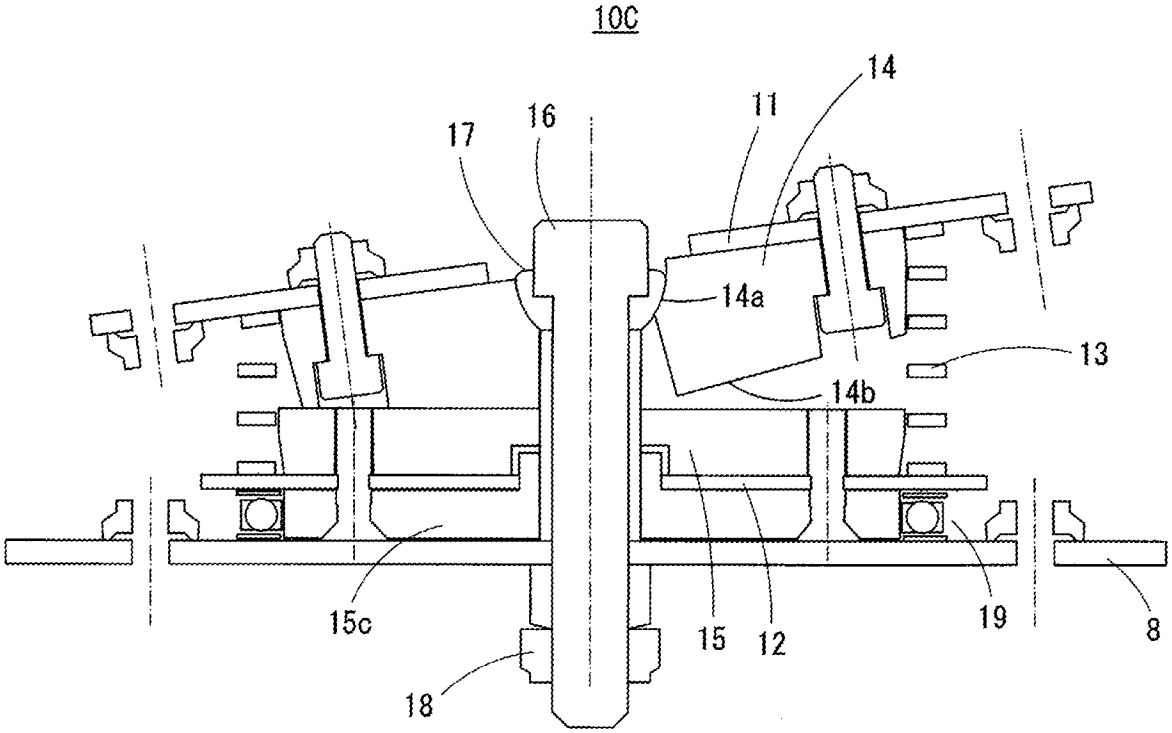
FIG. 13 is a detailed view of the tilt mechanism of FIG. 12 upon tilting of a seat.

A tiltable stool and tilt mechanism 10C according to further embodiments are described below, with reference to FIGS. 10 to 13. FIG. 10 is a cross-sectional view depicting an overall structure of a tall, fixed-height tiltable stool. FIG. 11 is a cross-sectional view depicting an overall structure of a short tiltable stool. FIG. 12 is a detailed view of the tilt mechanism 10C. FIG. 13 is a detailed view of the tilt mechanism 10C upon tilting of a seat.

With reference to FIG. 10, the tall, fixed-height tiltable stool includes a seat support column 51 of a fixed length and a seat 50 mounted to an upper end of the seat support column 51. The tilt mechanism 10C is connected to a lower end of the seat support column 51. The tilt mechanism 10C is mounted on a seat mount 52 via a rotary member 19, not shown. The tiltable stool is not vertically adjustable, and can rotate owing to the provision of the rotary member 19.

With reference to FIG. 11, the short tiltable stool includes a hollow, generally cylindrical seat support 56 and a seat 50 mounted to an upper end of the seat support 56. The tilt mechanism 10C is connected to a lower end of the seat support 56 via bolts 11*d*. The tilt mechanism 10C is mounted on a seat mount 57 via a rotary member 19, not shown. The tiltable stool is short and not vertically adjustable.

Specifically, the hollow, generally cylindrical seat support 56 includes an opening at the upper end thereof and an inner compartment. The seat 55 is removably attached to the upper end of the seat support 56 to open and close the opening thereof.

As shown in FIG. 12, the tilt mechanism 10C includes an upper spring retainer 11 and a lower spring retainer 12 disposed opposite each other to sandwich a coiled wave spring 13 disposed between the upper spring retainer 11 and the lower spring retainer 12. A fastener bolt 16 passes through an opening formed in an approximate center of each of the upper spring retainer 11 and the lower spring retainer 12 to hold together the components of the tilt mechanism 10C.

The tilt mechanism 10C also includes a tilt limiter 14 and a contact member 15 each disposed radially inside the coiled wave spring 13. The tilt limiter 14 includes a conical surface 14*b* on a bottom side thereof. The contact member 15 includes a planar contact surface on an upper side thereof. The contact member 15 is positioned below the tilt limiter 14, so that the tilt limiter conical surface 14*b* faces the planar contact surface. One or more bolts 14*c* secure the tilt limiter 14 in position onto the upper spring retainer 11. One or more bolts 12*b* secure the contact member 15 in position onto the lower spring retainer 12.

The tilt limiter 14 and the contact member 15 each comprise a generally annular member with an opening at a center thereof. The fastener bolt 16 is inserted from above into the central openings of the tilt limiter 14 and the contact member 15, and then through a securing nut 8*b* affixed to a bottom side of a base 8. Thus, the fastener bolt 16 is mounted with its head oriented upward. A ball member 17 defining a convex spherical surface is disposed around a shoulder of the fastener bolt 16. A concave spherical surface 14*a* is formed in the tilt limiter 14 to engage the convex spherical surface of the ball member 17.

A rotary member or thrust bearing 19 is connected to a bottom of the lower spring retainer 12. A spacer 15*c* is disposed between the lower spring retainer 12 and the base 8. A spacer collar 16*a* is disposed around the fastener bolt 16. A nut 18 is disposed at the distal end of the fastener bolt 16.

In operation, the tilt mechanism 10C allows the stool to tilt in response to a user's shifting of weight. Specifically, with additional reference to FIG. 13, which depicts the tilt mechanism 10C upon tilting of the seat 50, where a seated user leans to one side to apply load against the seat 50 in a given direction, the coiled wave spring 13 deflects as the column 51 inclines and the upper spring retainer 11 tips sideways, which in turn causes the tilt limiter 14 to move in sync with the upper spring retainer 11. With the convex spherical surface of the ball member 17 sliding against the concave spherical surface 14*a* of the tilt limiter 14, the fastener bolt 16 remains stationary in its upright position.

When the seat 50 is inclined to a prescribed tilt angle (for example, 8 degrees in the present embodiment), the conical surface 14*b* of the tilt limiter 14 abuts the contact surface of the contact member 15, thereby limiting further tilt of the seat 50 beyond the prescribed tilt angle.

Further, where a twisting force is applied to the seat 50, the torque is transmitted through the upper spring retainer 11 to the upper end of the coiled wave spring 13. In that case, since the thrust bearing 19 permits rotation between the parts, the coiled wave spring 13 is not twisted out of shape.

The operation of the tilt mechanism 10C is described above in relation to the embodiment of FIG. 10. Since the tilt mechanism 10C is operable in a similar manner in conjunction with the embodiment of FIG. 11, a further description is omitted for brevity.

Figure 14:
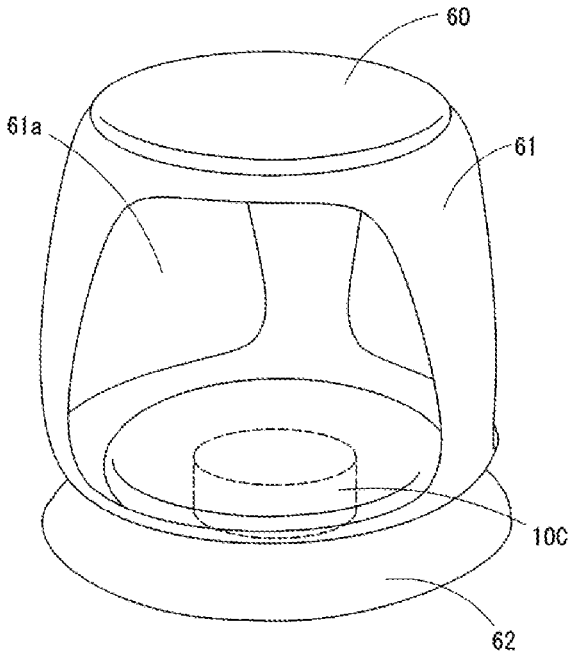
FIG. 14 is a perspective view of a tiltable stool according to yet another embodiment.

FIG. 14 is a perspective view of a tiltable stool according to yet another embodiment.

As depicted in FIG. 14, the tiltable stool includes a hollow, generally cylindrical seat support 61 and a seat 60 mounted to an upper end of the seat support 61. The tilt mechanism 10C is connected to a lower end of the seat support 61. The tilt mechanism 10C is mounted on a base 62 via a rotary member 19, not shown.

Specifically, the hollow, generally cylindrical seat support 61 comprises a barrel-shaped container with a curved circumference which includes an inner compartment to accommodate an article therein. The seat 60 is fixedly attached to the upper end of the seat support 61. Multiple openings 61*a* are provided on one or more sides of the seat support 61. Since the tilt mechanism 10C of FIG. 14 is operable in a similar manner as described earlier, a further description is omitted for brevity.

Tiltable lounge chairs according to further embodiments are described below with reference to FIGS. 15, 16A and 16B.

Figure 15:
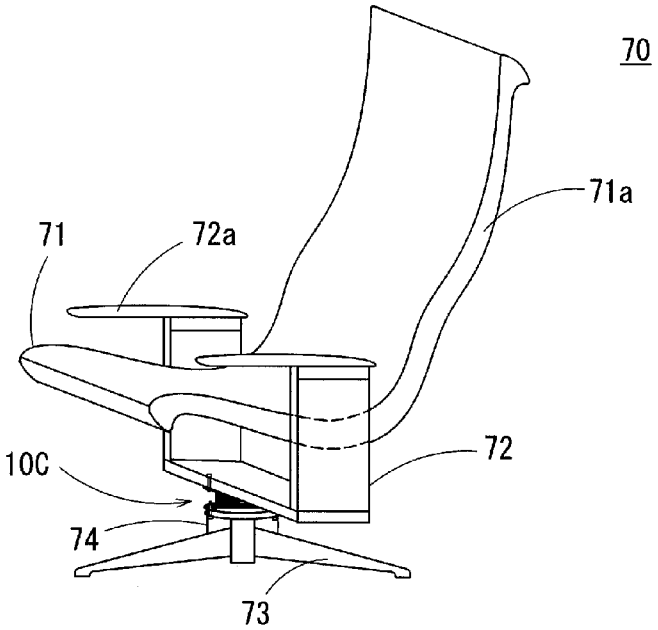
FIG. 15 is a perspective view of a tiltable lounge chair according to yet another embodiment.

FIG. 15 is a perspective view of a tiltable lounge chair 70 according to one embodiment.

As depicted in FIG. 15, the tiltable lounge chair includes a seat 71 having an integral backrest 71*a* slightly inclined for a single person to lounge thereon, and a seat support 72 to which the seat 71 is securely mounted. The seat support 72 is secured to a seat mount 74 via a tilt mechanism 10C. The seat mount 74 is secured to a base 73.

Specifically, the seat support 72 comprises a generally U-shaped frame including a bottom side extending below the seat 71, a pair of opposed lateral sides each extending upward from the bottom side, and a pair of armrests 72*a* disposed on distal ends of the pair of opposed lateral sides.

Since the tilt mechanism 10C of FIG. 15 is operable in a similar manner as described earlier, a further description is omitted for brevity.

Figure 16A:
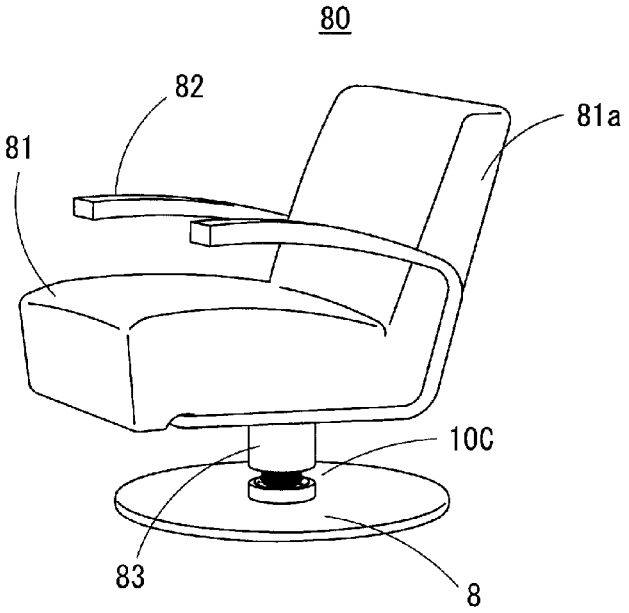
FIGS. 16A and 16B are perspective views of a tiltable lounge chair according to yet another embodiment.
Figure 16B:
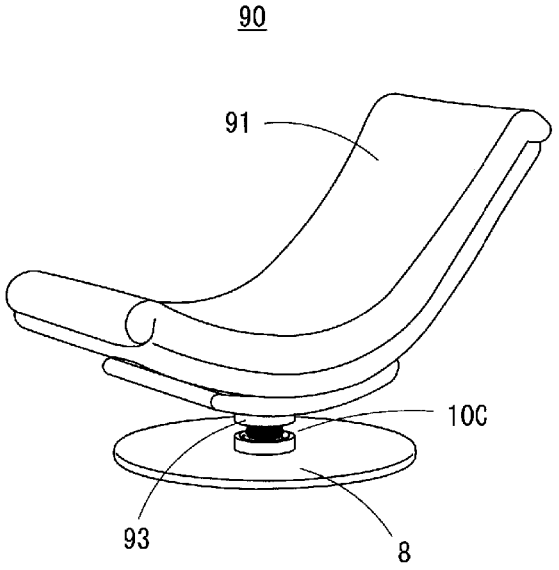

FIGS. 16A and 16B are perspective views of tiltable lounge chairs 80 and 90, respectively, according to further embodiments.

As depicted in FIG. 16A, the tiltable lounge chair 80 includes a seat 81 with an integral backrest 81*a*, and a seat stand 83 secured to a bottom of the seat 81. The seat support 83 is connected to a base 8 via a tilt mechanism 10C. The tilt mechanism 10C is similar to that depicted in FIG. 11, including a thrust bearing 19, not shown. A pair of armrests 82 is provided on opposite sides of the seat 81.

As depicted in FIG. 16B, the tiltable lounge chair 90 includes a seat 91 with an integral backrest, and a seat stand 93 secured to a bottom of the seat 91. The seat support 93 is connected to a base 8 via a tilt mechanism 10C. The tilt mechanism 10C is similar to that depicted in FIG. 11, including a thrust bearing 19, not shown.

In operation, the tilt mechanism 10C allows the lounge chairs 70, 80, and 90 to tilt in response to a user's shifting of weight. Specifically, where a seated user leans to one side to apply load in a given direction, the seats 71, 81, and 91 tilt accordingly. When the seats 71, 81, and 91 are inclined to a prescribed tilt angle (for example, 8 degrees in the present embodiment), the conical surface 14*b* of the tilt limiter 14 abuts the contact surface of the contact member 15, thereby limiting further tilt of the seats 71, 81, and 91 beyond the prescribed tilt angle. Further, the lounge chairs 70, 80, and 90 are freely rotatable in a desired direction, owing to the provision of the thrust bearing 19.

The lounge chairs according to the above embodiments may be equipped with the maximum tilt angle adjuster 20 and the tilt resistance adjuster 30. Since the basic functionality and structure of these components are same as the embodiment depicted earlier, a further description is omitted for brevity.

It is to be understood that the present invention is not limited to the illustrated embodiments described herein. Various types and styles of user interfaces may be used in accordance with the present invention without limitation. Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

LIST OF REFERENCE NUMERALS

1 Seat
2 Seat support column
3*a* Upper cover
3*b* Lower cover
3*c* Through-hole
4 Gas spring
5 Cover
6 Lever
7 Bracket
7*a* Through-hole
8 Base
8*a* Bolt
8*b* Securing nut
10 Tilt mechanism
10A Tilt mechanism
10B Tilt mechanism
10C Tilt mechanism
11 Upper spring retainer
11*a* Nut

11*b* Securing nut
11*c* Stopper
11*d* Bolt
12 Lower spring retainer
12*a* Nut
12*b* Bolt
13 Coiled wave spring
13*a* Elastic member
14 Tilt limiter
14*a* Concave spherical surface
14*b* Conical surface
14*c* Bolt
14*d* Annular groove
15 Contact member
15*a* Bolt
15*b* Securing nut
15*c* Spacer
16 Fastener bolt
16*a* Collar
17 Ball member
18 Nut
19 Thrust bearing
20 Maximum tilt angle adjuster
21 Flange ring
21*a*, 21*b*, 21*c* Multi-level flange surfaces
22 Guide groove
23 Tilt angle adjustment lever
24 Guide groove
25 Ring guide
25*a* Guide rib
26 Positioning member
26*a* Spring-loaded ball lock
30 Tilt resistance adjuster
31 Worm wheel
32 Gear case
33 Worm shaft
34 Worm
35 Hex key
40 Seat
41 Upper cover
42 Lower cover
42*a* Through-hole
43 Gas spring
44 Lever
50 Seat
51 Seat support column
52 Seat mount
55 Seat
56 Seat support
57 Seat mount
60 Seat
61 Seat support
61*a* Opening
62 Base
70 Lounge chair
71 Seat
71*a* Backrest
72 Frame
72*a* Armrest
73 Base
74 Seat mount
80 Lounge chair
81 Seat
81*a* Backrest
82 Armrest
83 Seat stand
90 Lounge chair
91 Seat
93 Seat stand

The invention claimed is:

1. A tiltable stool, comprising:

a seat support column including a gas spring disposed inside the seat support column;

a seat mounted to an upper end of the seat support column;

a tilt mechanism disposed adjacent to a floor to allow the seat to tilt in a desired direction, the tilt mechanism including:

a coiled wave spring;

an upper spring retainer and a lower spring retainer disposed opposite each other to sandwich the coiled wave spring therebetween;

a fastener bolt disposed at an approximate center of the upper spring retainer to pivotably hold the upper spring retainer in position; and a tilt limiter disposed inside the coiled wave spring and secured to either the upper spring retainer or the lower spring retainer, the tilt limiter including a conical surface thereon, the conical surface contacting a contact surface when the seat tilts to a predetermined tilt angle, wherein the upper spring retainer is secured to a lower end of the seat support column.

2. A tiltable stool, comprising:

a seat support;

a seat mounted to an upper end of the seat support;

a tilt mechanism disposed adjacent to a floor to allow the seat to tilt in a desired direction, the tilt mechanism including:

a coiled wave spring;

an upper spring retainer and a lower spring retainer disposed opposite each other to sandwich the coiled wave spring therebetween;

a fastener bolt disposed at an approximate center of the upper spring retainer to pivotably hold the upper spring retainer in position; and a tilt limiter disposed inside the coiled wave spring and secured to either the upper spring retainer or the lower spring retainer, the tilt limiter including a conical surface thereon, the conical surface contacting a contact surface when the seat tilts to a predetermined tilt angle, wherein the upper spring retainer is secured to a lower end of the seat support; and a rotary member connected to a bottom of the lower spring retainer, wherein the seat support includes either a column of a fixed length or a hollow, generally cylindrical body.

3. The tiltable stool according to claim 2, wherein the seat support comprises a hollow, generally cylindrical body including an opening at an upper end thereof and an inner compartment to accommodate an article therein, and wherein the seat comprises either:

(i) a removable seat removably attached to the upper end of the seat support to open and close the opening thereof, or (ii) a stationary seat fixedly attached to the upper end of the seat support, wherein multiple openings are provided on one or more sides of the hollow, generally cylindrical body.

4. A tiltable lounge chair, comprising:

a seat support;

a seat mounted on the seat support;

a tilt mechanism disposed adjacent to a floor to allow the seat to tilt in a desired direction, the tilt mechanism including:

a coiled wave spring;

an upper spring retainer and a lower spring retainer disposed opposite each other to sandwich the coiled wave spring therebetween;

a fastener bolt disposed at an approximate center of the upper spring retainer to pivotably hold the upper spring retainer in position; and a tilt limiter disposed inside the coiled wave spring and secured to either the upper spring retainer or the lower spring retainer, the tilt limiter including a conical surface thereon, the conical surface contacting a surface when the seat tilts to a predetermined tilt angle, wherein the upper spring retainer is secured to a lower end of the seat support;

a rotary member connected to a bottom of the lower spring retainer; and a base having the lower spring retainer mounted thereon, with the rotary member interposed between the base and the lower spring retainer;

wherein the seat support includes either:

(i) a generally U-shaped frame including a bottom side extending below the seat, a pair of opposed lateral sides each extending upward from the bottom side, and a pair of armrests disposed on distal ends of the pair of opposed lateral sides, or (ii) a seat stand secured to a bottom of the seat, wherein the seat includes an integral backrest extending therefrom.

5. The tiltable stool according to claim 1, further comprising:

an elastic member disposed between the upper spring retainer and the lower spring retainer to exert a biasing force upon tilting of the seat.

6. The tiltable stool according to claim 1, further comprising:

a rotatable flange ring disposed outside and concentrically with the coiled wave spring, the rotatable flange ring including four radially disposed sets of multi-level flange surfaces;

multiple radially disposed stoppers secured to a bottom surface of the upper spring retainer; and a tilt angle adjustment lever operably connected to the rotatable flange ring to rotate the rotatable flange ring therewith, wherein a maximum tilt angle of the seat is adjustable by rotating the rotatable flange ring to position the flange surface of a particular height to meet one of the multiple stoppers.

7. The tiltable stool according to claim 6, further comprising:

a positioning mechanism to guide and retain the rotatable flange ring in position, the positioning mechanism including:

a guide groove formed in an outer circumference of the rotatable flange ring to guide the rotatable flange ring while changing the maximum tilt angle;

multiple positioning holes defined adjacent to the guide groove in the outer circumference of the rotatable flange ring; and a spring-loaded ball lock disposed around the outer circumference of the rotatable flange ring, wherein the spring-loaded ball lock engages one of the multiple positioning holes to hold the rotatable flange ring in position when the maximum tilt angle of the seat is established.

8. The tiltable stool according to claim 1, further comprising:

a nut configured to have the fastener bolt screwed therethrough, the nut being secured to either an approximate center of an upper surface of the upper spring retainer or an approximate center of a bottom surface of the lower spring retainer; and a tilt resistance adjustment lever operably connected to a distal end of the fastener bolt to rotate the fastener bolt therewith, wherein a tilt resistance of the coiled wave spring is adjustable by rotating the fastener bolt, thereby changing a distance between the upper spring retainer and the lower spring retainer.

* * * * *